US005943031A

United States Patent [19]

Tokunaga et al.

[11] Patent Number: 5,943,031

[45] Date of Patent: Aug. 24, 1999

[54] METHOD FOR DRIVING A PLASMA DISPLAY PANEL

[75] Inventors: Tsutomu Tokunaga; Kenichi Kobayashi, both of Koufu, Japan

[73] Assignee: Pioneer Electronic Corporation, Tokyo, Japan

[21] Appl. No.: 08/934,004

[22] Filed: Aug. 28, 1997

[30] Foreign Application Priority Data

Sep. 6, 1996 [JP] Japan ..... 8-257653

[51] Int. Cl.[6] ..... G09G 3/28

[52] U.S. Cl. ..... 345/60; 345/68; 315/169.4

[58] Field of Search ..... 345/60, 62, 68, 345/204, 66, 67; 315/169.4, 169.3

[56] References Cited

U.S. PATENT DOCUMENTS

| | | | |
|---|---|---|---|
| 5,446,344 | 8/1995 | Kanazawa | 315/169.4 |
| 5,661,500 | 8/1997 | Shinoda et al. | 345/60 |
| 5,684,499 | 11/1997 | Shimizu et al. | 345/60 |

*Primary Examiner*—Richard A. Hjerpe
*Assistant Examiner*—Francis Nguyen
*Attorney, Agent, or Firm*—Perman & Green, LLP

[57] ABSTRACT

A method for driving a matrix type of plasma display panel is capable of stably displaying an image in error-discharge free. The plasma display panel including a plurality of row electrodes extending parallel to each other, two adjacent ones of the row electrodes being paired, and a plurality of column electrodes extending perpendicularly to the row electrodes at a given intervals wherein a region in which, one pair of row electrodes and one column electrode are crossed and spaced with a distance to each other at an intersection corresponding to one pixel. The method includes the steps of: applying first resetting pulses to all of the row electrodes simultaneously to cause discharges between all of the pairs of row electrodes, each first resetting pulse including a pulse rise or pulse fall time longer than each duration of the sustain pulse for sustaining a discharge emission as a simultaneous resetting step; applying a second resetting pulse to one of the pair of row electrodes to cause discharge therebetween immediately after applying the first resetting pulse to the one of the pair of row electrodes; applying a scan pulse to every pair of row electrodes and simultaneously applying a pixel data pulse to every column electrode to write pixel data to the associated pixels in accordance with pixel data pulses applied; and applying a series of sustain pulses alternately to one of the row electrode pair and the other thereof to maintain sustain-discharge between the pair of row electrodes.

7 Claims, 6 Drawing Sheets

METHOD FOR DRIVING A PLASMA DISPLAY PANEL

BACKGROUND OF THE INVENTION

1. Field of the Invention

This invention relates to a method for driving a surface discharge and matrix type of plasma display panel (also designated as a PDP hereinafter).

2. Description of the Related Art

The plasma display panel is well known as one of thin two-dimensional displays, and various researches and studies have recently been conducted on the plasma display panels. An AC discharge and matrix type of plasma display panel having a memory function is well known as one of such plasma display panels.

FIG. 1 shows a schematic diagram of a plasma display apparatus including a plasma display panel.

Referring to FIG. 1, a driving apparatus 100 receives video signals and converts a set of the received video signals every one pixel to digital pixel data. The driving apparatus 100 then generates pixel data pulses corresponding to the pixel data to apply the pixel data pulses to column electrode Dl to Dm in the plasma display panel 11. The PDP 11 comprises the column electrodes D1 to Dm, and row electrodes X1 to Xn and Y1 to Yn extending perpendicularly to the column electrodes, in which two adjacent ones of the row electrodes Xi and Yi are paired to one another to form a row of the display on the display panel. The PDP further includes a dielectric layer formed between the column and row electrodes. A cross section in which a pair of row electrodes and a column electrode are crossed with a space to each other constitutes a single pixel cell.

The driving apparatus 100 produces priming pulses PPx and PPy for all of the row electrodes in the PDP 11 and then applies the pulses PPx and PPy to the respective row electrodes X1 to Xn, and Y1 to Yn to forcibly cause a discharge between a pair of row electrode Xi and Yi for generating (or destroying) wall-charge within the pixel cell. The driving apparatus 100 also generates a scan pulse SP for writing the pixel data in the PDP 11, and sustain pulses IPx and IPy for sustaining a discharge emission, an erasing pulse EP for ceasing a sustained discharge emission, thereby applying these pulses to the row electrodes X1 to Xn, and Y1 to Yn in the PDP 11.

The applicant in Japan of this application have filed Japanese Patent Application Heisei 7-90977 (corresponding to U.S. patent Ser. No. 632,127 filed) which suggested a method for driving the PDP which is capable of lightening correctly emission elements and displaying an image together with the improvement of address margin.

FIGS. 2A to 2E show the timing charts for applying the above various types of driving pulses to the various electrodes to illustrate the suggested method for driving the PDP.

Referring to FIGS. 2A to 2E, the driving apparatus 100 supplies all of the row electrodes X1 to Xn with the priming pulses PPx which have a negative potential, and simultaneously supplies all of the row electrodes Y1–Yn with the priming pulses PPy which have a positive potential. The application of the priming pulses causes discharges between the pair of row electrodes in all of the pixel cells of the PDP 11. The discharge produces charged particles in each of the pixel cells. After the disappearance of the discharge, the wall charge remains in the dielectric layer (simultaneous priming step). The priming pulses PPx, PPy with a long time constant are used for suppressing the discharge emission non-related to the displaying due to themselves to improve the contrast.

The driving apparatus 100 then applies pixel-data pulses DP1 to DPn corresponding to pixel data at every row to the column electrodes D1 to Dm in turn. The driving apparatus 100 synchronizes the timing for applying the scan pulse SP with the timing for applying the pixel data pulses DP1–DPn, thereby applying the scan pulse SP to the row electrodes Y1 to Yn in turn. At this moment, discharge occurs in the only pixel cell in which both of the scan pulse SP and the pixel data pulse DP are simultaneously applied to the column and row electrodes, respectively, so that most of the wall charge which has been generated by the simultaneous priming step disappears.

On the contrary, no discharge occurs within the pixel cell in which a pixel data pulse is not applied but only a scan pulse SP is applied, so that a desired amount of the wall charge which has been generated by the simultaneous priming step is left in the cell. In other words, the desired amount of wall charge in the cell which has been produced by the simultaneous priming step is selected in accordance with the contents of the pixel data to be lost (pixel data selecting or the addressing step).

The driving apparatus 100 then applies a series of sustain pulse IPx, each of which has a positive polarity, to the row electrodes X1 to Xn, and applies a series of another sustain pulses IPy, each of which has a positive polarity, to the row electrodes Y1–Yn at the offset timings from those of the sustain pulses IPx. The pixel cells which hold the wall charge only maintain the discharge emissions (sustain discharge step).

The driving apparatus 100 then applies erasing pulses to the respective row electrodes Y1 to Yn to cease the discharge emissions (sustain discharge ceasing step).

In this case of the driving method above mentioned, the priming pulses with a pulse rise or pulse fall time each having a duration longer than that of the sustain pulses for sustaining a discharge emission during the simultaneous priming step. Therefore, the priming discharge becomes very weak in comparison with the sustained discharge. Accordingly, when the simultaneous priming step is performed, the timings of discharge in the pixel cells differ from each other, so that the amounts of the wall charges formed in the pixel cells are different from each other. As a result, the next operation of the addressing step is not stabilized.

The main object of the invention is to provide a method for driving a matrix type of plasma display panel which is able to stably indicate a precise emission display associated with the pixel data.

SUMMARY OF THE INVENTION

The aforementioned problems are overcome and advantages are provided by a method for driving a matrix type of plasma display panel displaying an image according to the present invention, said plasma display panel including a plurality of row electrodes extending parallel to each other, two adjacent ones of said row electrodes being paired, and a plurality of column electrodes extending perpendicularly to the row electrodes at a given intervals wherein a region in which, one pair of row electrodes and one column electrode are crossed and spaced with a distance to each other at an intersection corresponding to one pixel, said method comprising the steps of:

applying first resetting pulses to all of the row electrodes simultaneously to cause discharges between all of the pairs of row electrodes, each first resetting pulse including a pulse rise or pulse fall time longer than each duration of the sustain pulse for sustaining a discharge emission as a simultaneous resetting step;

applying a second resetting pulse to one of the pair of row electrodes to cause discharge therebetween immediately after applying the first resetting pulse to the one of the pair of row electrodes;

applying a scan pulse to every pair of row electrodes and simultaneously applying a pixel data pulse to every column electrode to write pixel data to the associated pixels in accordance with pixel data pulses applied; and applying a series of sustain pulses alternately to one of the row electrode pair and the other thereof to maintain sustain-discharge between the pair of row electrodes.

According to the method for driving a matrix type of plasma display panel of the present invention, the application of the second resetting pulse to the one of the pair of row electrodes immediately after applying the first resetting pulse thereto may reduce the difference of wall charges caused by the first resetting pulses.

In a second aspect of the present invention, the method for driving a matrix type of plasma display panel is characterized in that the first resetting pulse comprises one resetting pulse having a predetermined polarity applied to the one of the row electrodes and an other resetting pulse having an inverse polarity to said predetermined polarity simultaneously applied to the other row electrode, and in that the second resetting pulse has an inverse polarity to said predetermined polarity.

According to the second aspect of the method for driving a matrix type of plasma display panel of the present invention, it may reduce the difference of wall charges caused by the first resetting pulses, because the first resetting pulse comprises one resetting pulse having a predetermined polarity applied to the one of the row electrodes and an other resetting pulse having an inverse polarity to said predetermined polarity simultaneously applied to the other row electrode, and the second resetting pulse has an inverse polarity to said predetermined polarity.

In a third aspect of the present invention, the method for driving a matrix type of plasma display panel further comprises a step of applying a priming pulse to every pair of the row electrodes immediately before the scan pulse is applied thereto in the addressing step.

According to the third aspect of the method for driving a matrix type of plasma display panel of the present invention, it may reduce the differences at every row electrode both of the amount of wall charges and the number of charged particles accelerating the discharge formation generated by the priming pulses, because the method for driving a matrix type of plasma display panel further comprises a step of applying a priming pulse to every pair of the row electrodes immediately before the scan pulse is applied thereto in the addressing step.

In a fourth aspect of the present invention, the method for driving a matrix type of plasma display panel is characterized in that each row electrode has a width of 300 micrometers in the pixel.

According to the fourth aspect of the present invention of the method for driving a matrix type of plasma display panel, since each row electrode has a width of 300 micrometers in the pixel, the sustained discharge emission is enhanced.

In a fifth aspect of the present invention, the method for driving a matrix type of plasma display panel is characterized in that, the pair of row electrodes have projecting portions respectively opposite to each other through a discharge gap in the pixel cell.

According to the fifth aspect of the present invention of the method for driving a matrix type of plasma display panel, since the pair of row electrodes have projecting portions respectively opposite to each other through a discharge gap in the pixel cell, the resetting discharge is localized.

In a sixth aspect of the present invention, the method for driving a matrix type of plasma display panel is characterized in that, each of said projecting portion comprises a wider portion positioned near the discharge gap and a narrower portion extending from the wider portion.

According to the sixth aspect of the present invention of the method for driving a matrix type of plasma display panel, since each of said projecting portion comprises a wider portion positioned near the discharge gap and a narrower portion extending from the wider portion, the resetting discharge is localized still more.

BRIEF DESCRIPTION OF THE DRAWINGS

The aforementioned aspects and other features of the invention are explained in the following description, taken in connection with the accompanying drawing figures wherein.

For a better understanding of the invention reference is made to the following detailed description of the preferred embodiments.

DETAILED DESCRIPTION OF THE PREFERRED EMBODIMENTS

Figure 3:
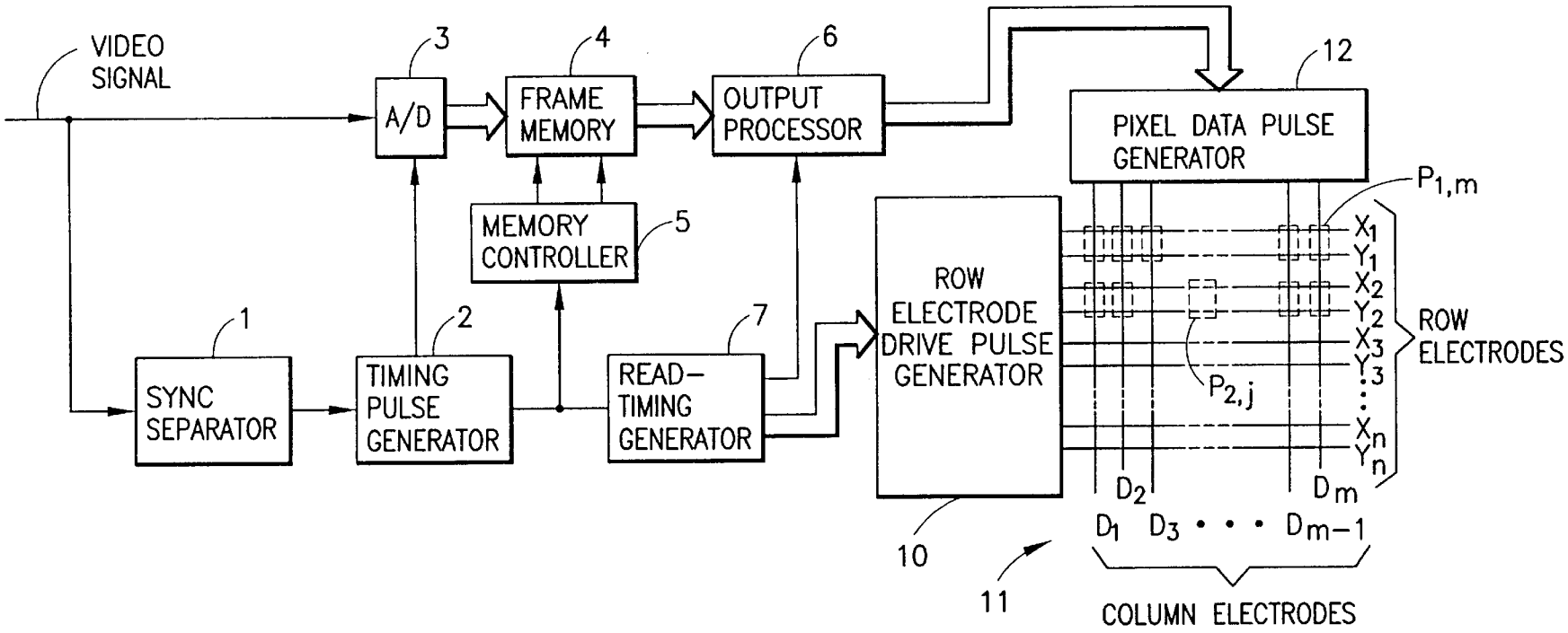
FIG. 3 is a block diagram showing a plasma display apparatus.

FIG. 3 is a block diagram showing a plasma display apparatus including a driving apparatus for driving a plasma display panel by means of the driving technique according to the invention.

Referring to FIG. 3, a sync separator 1 receives input video signals and then extracts horizontal and vertical synchronous signals from the received input video signals to supply the extracted synchronous signals to a timing pulse generator 2. The timing pulse generator 2 produces an extracted synchronous signal timing pulse on the basis of the extracted horizontal and vertical synchronous signals to supply the produced extracted synchronous signal timing pulse to an A/D converter 3, a memory controller 5, and a read-timing signal generator 7.

The A/D converter 3 converts input video signals per pixel to digital pixel data synchronizing with the extracted synchronous signal timing pulse to provide the converted digital pixel data to a frame memory 4. The memory comptroller 5 supplies write and read pulses synchronous with the extracted synchronous-signal-timing-pulse to the frame memory 4. The frame memory 4 receives pixel data supplied from the A/D converter 3 in turn in response to the received write signal.

In addition, the frame memory 4 also reads out the pixel data which have been stored in the frame memory 4 in turn to supply the pixel data to an output processor 6. The read-timing signal generator 7 generates various types of timing signals for controlling the operation for discharge emissions to supply these timing signal to a row electrode driving pulse generator 10 and the output processor 6. The output processor 6 receives the pixel data from the memory 4 to supply the received pixel data to a pixel data pulse generator 12 synchronizing with the timing signal from the read timing signal generator 7.

The pixel data pulse generator 12 receives pixel data supplied from the output processor 6 to generate the pixel data pulses DP corresponding to the received pixel data, thereby applying the pixel data pulses DP to the column electrodes D1 to Dm in the PDP 11. The row electrode driving pulse generator 10 generates first resetting pulses RPx1 and RPy and a second resetting pulse RPx2 for compulsorily generating the discharge between all of the pair of row electrodes in the PDP 11 to produce charged particles in the discharge region of the PDP (described later), and further produces priming pulses PPx for reproducing the charged particles, a scan pulse for writing the pixel data on the associated pixels, a series of sustain pulses IPx and IPY for sustaining the discharge emissions in the pixel cell, and an erasing pulse EP for ceasing the sustained discharge emission, to apply these pulses to the row electrodes X1 to Xn, and Y1 to Yn, in response to each of the various types of timing signal supplied from the read-timing signal generator 7.

Figure 4:
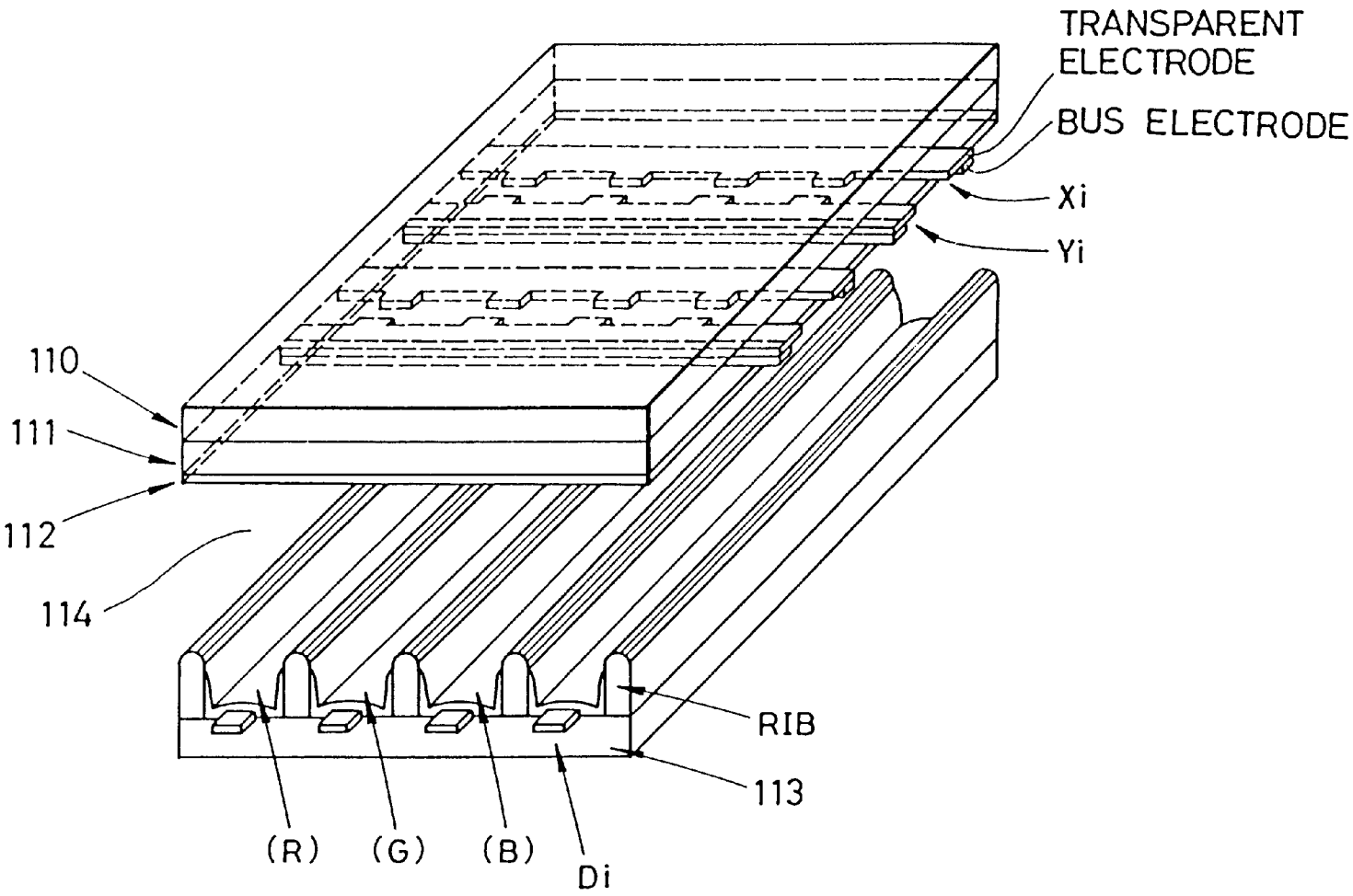
FIG. 4 is a partially enlarged perspective view showing a plasma display.
Figures 5A, 5B, 5C, 5D, 5E:
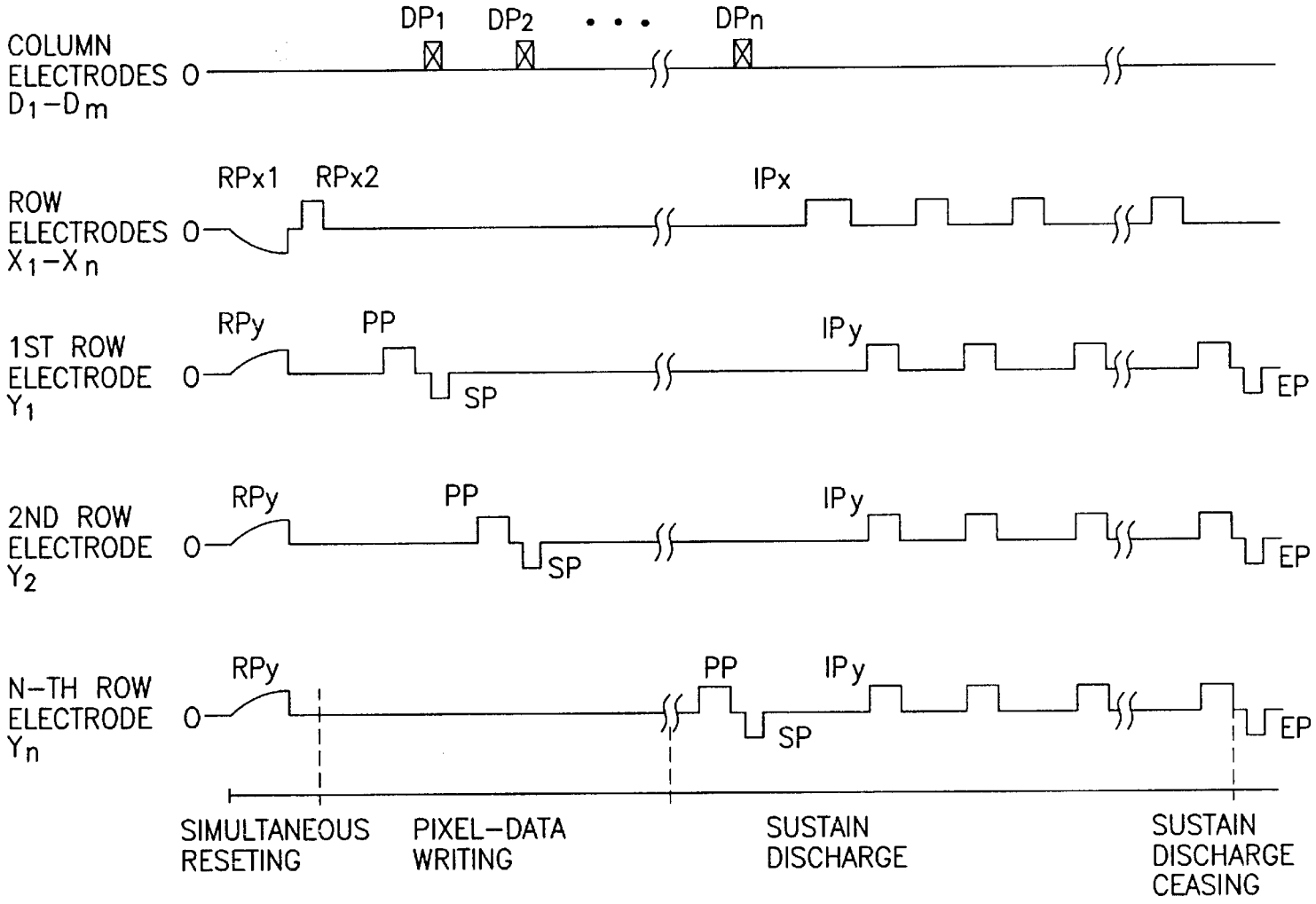
FIGS. 5A to 5E are waveform charts of driving technique of a preferred embodiment according to the present invention, which show the timings for applying various driving pulses to the electrodes.

FIG. 4 shows a schematic diagram of the construction of the PDP 11.

Referring to FIG. 4, a front face substrate 110 made of glass is arranged parallel to a back substrate 113 made of glass. The row electrodes X1 to Xn, and Y1 to Yn, are formed on an internal surface of the front substrate 110 which faces the back substrate 113 at an interval. Each row electrode comprises a transparent electrode formed on the substrate and a bus electrode formed on the transparent electrode. A set of adjoining row electrodes Xi and Yi (1<=i<=n) are arranged parallel to each other to provide a pair for sustaining the discharge. The row electrodes are covered with a dielectric layer 111. A MgO (Magnesium oxide) layer 112 is deposited on the dielectric layer 111. The discharge region 114 is provided between the MgO layer 112 and the back substrate 113. The column electrodes Di (*1*=<i=<n) i.e., address electrodes are formed on the back substrate 113 with fluorescent layer coverings for example R, G and B emissions. In the above back substrate, the address electrodes are partitioned by barrier ribs extending parallel to each other. In this arrangement, a pair of row electrodes Xi and Yi (1=<i=<n) are combined to function to display one row of an image appearing on the display surface. Furthermore, a section in which a pair of row electrodes and a column electrode are crossed to each other at an interval provides one pixel cell Pi, j on the display surface.

FIGS. 5A to 5E show waveform charts each illustrating a first preferred embodiment of the method according to the invention, which describes the timing for applying the various pulses to the PDP 11.

Referring to FIGS. 5A to 5E, the pixel-data pulses DP1 to DPn corresponding to a predetermined pixel data are basically applied to the column electrodes D1 to Dm in such a manner that the timing for applying the scan pulses SP is synchronized with the timing for applying the pixel data pulses DP1 to DPn. In a simultaneous resetting step, the row electrode driving pulse generator applies first resetting pulses RPx1, having a negative potential and a leading edge rising gradually, to all of the row electrodes X1 to Xn, and simultaneously applies another first resetting pulses RPy, having a positive potential and a leading edge rising gradually, to all of the row electrodes Y1 to Yn respectively. The application of the first resetting pulses causes discharges in all of the gaps between the row electrodes in the PDP 11, so that charged particles are produced in the discharge region 114 of all of the pixel cells Pij. After the termination of the discharge, a given amount of the wall charge is stored in the dielectric layer 111 of the pixel. Since the pulse waveform whose leading edge rises gradually is used, the timings of discharge are different from each other in the pixel cells so as to cause the differences of the remaining wall charges.

Figure 1:
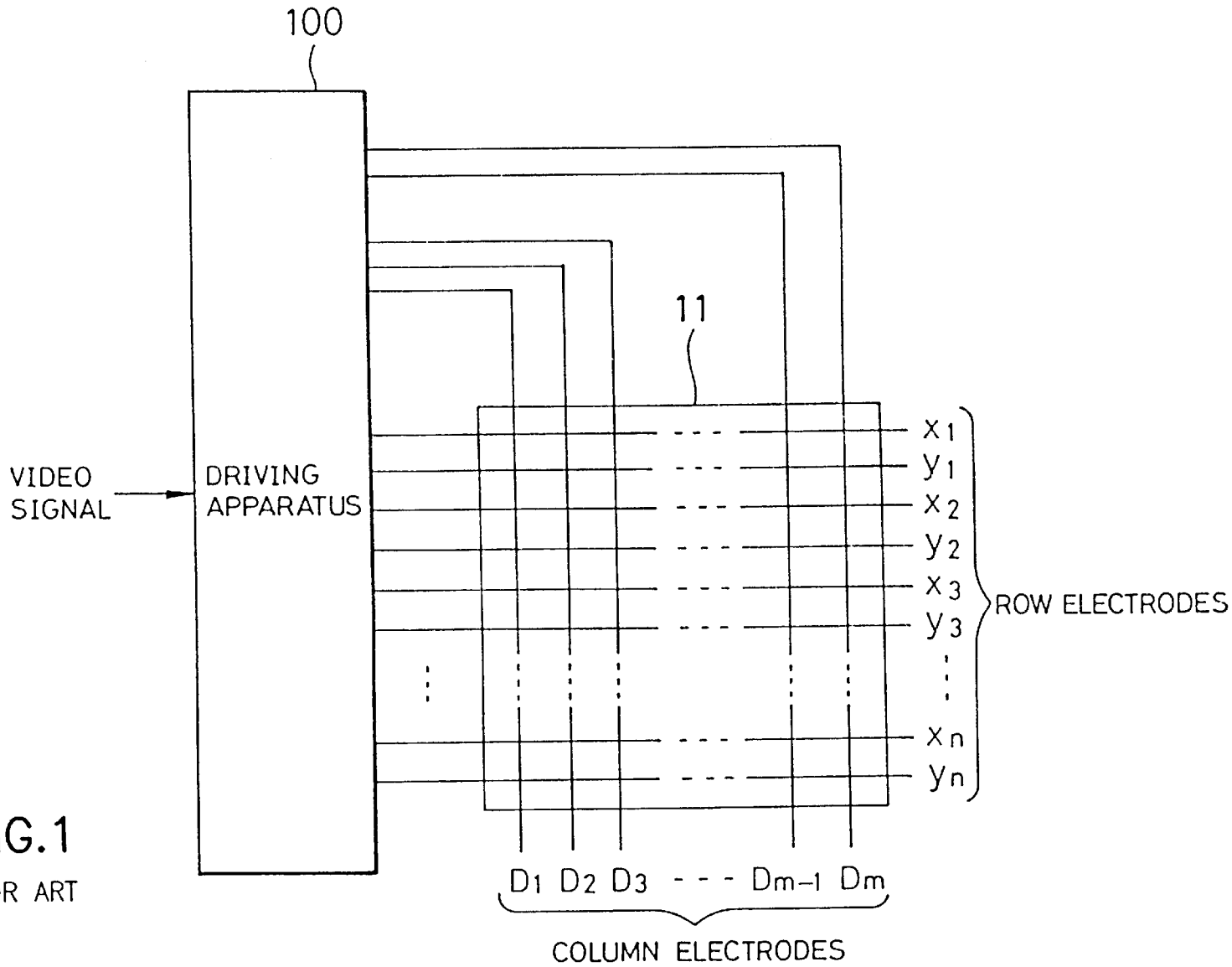
FIG. 1 PRIOR ART
FIG. 1 is a schematic diagram showing a plasma display apparatus including a matrix type of plasma display panel.
Figures 2A, 2B, 2C, 2D, 2E:
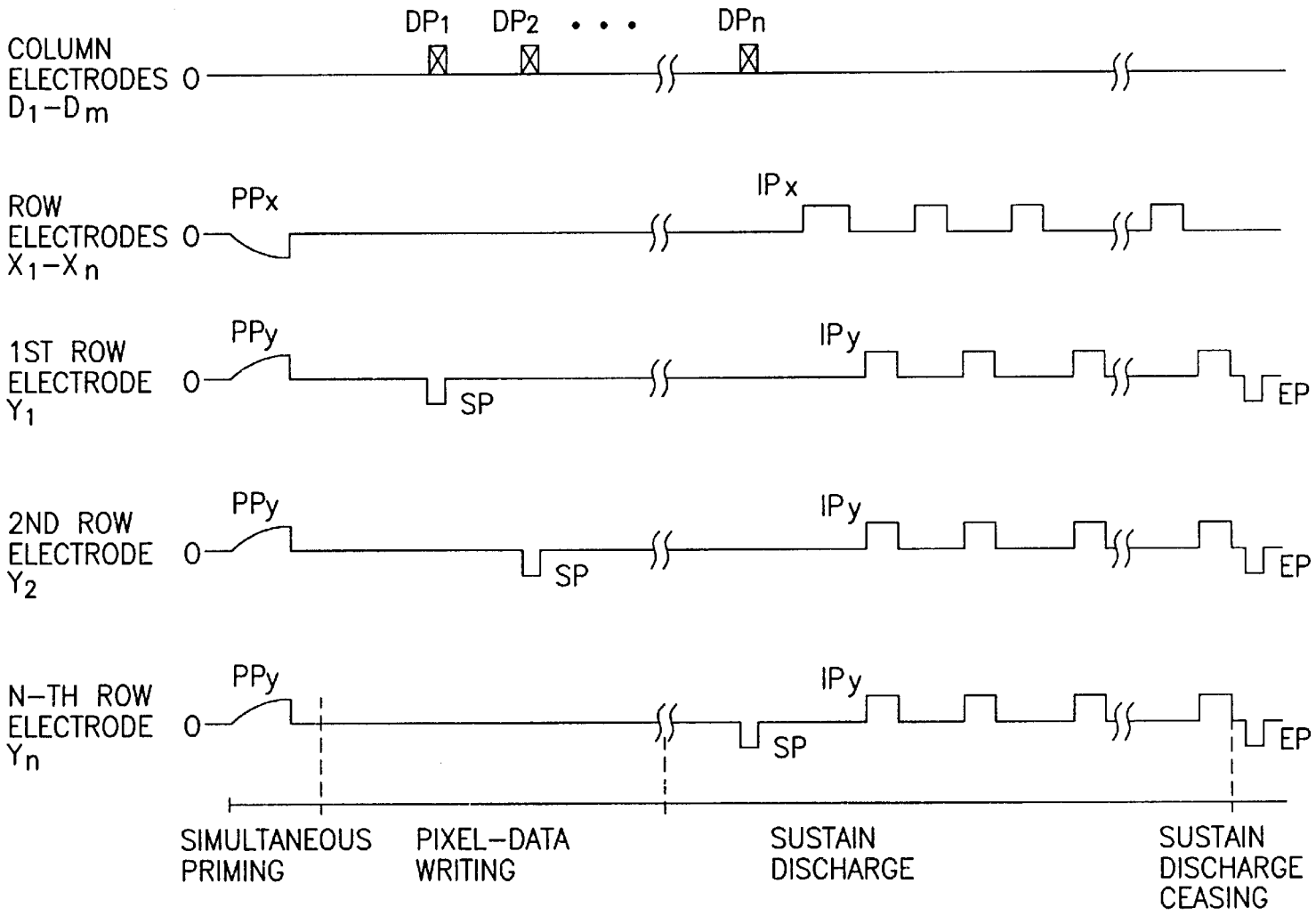
FIG.2A PRIOR ART
FIG.2B PRIOR ART
FIG.2C PRIOR ART
FIG.2D PRIOR ART
FIG.2E PRIOR ART
FIGS. 2A to 2E are waveform charts each showing the timing for applying a driving pulse to the respective electrode for driving a plasma display panel.

Then, immediately after the end of the first resetting pulses RPx1, the second resetting pulses RPx2 are applied to the row electrodes X1 to Xn, each RPx2 being positive pulses with a comparatively rapid rising edge. The application of the second resetting pulses RPx2 causes the discharge of the wall charges between the row electrodes X and Y, so as to reduce the remaining amount of the wall charge in the pixel cell. As a result, various operations after the application of the priming pulses PP may be performed without influence to each pixel cell caused by the difference of wall charges. In addition, the priming pulses PP are applied to the row electrodes Y1 to Yn immediately before applying the scan pulse SP to the electrodes as shown in FIGS. 2C to 2E. Therefore, the increase of the wall charge and the acceleration of discharge in each pixel cell are achieved by equating the interval between the priming pulse PP and the scan pulse SP every electrode and keeping such an interval short, although there is the different intervals in the electrodes from the end of the second resetting pulses RPx2 to the start of applying the priming pulses PP. Since the charged particles generated by the priming pulses are nearly equal to each other, the scan pulse SP performs the stable addressing operation.

Figure 6A:
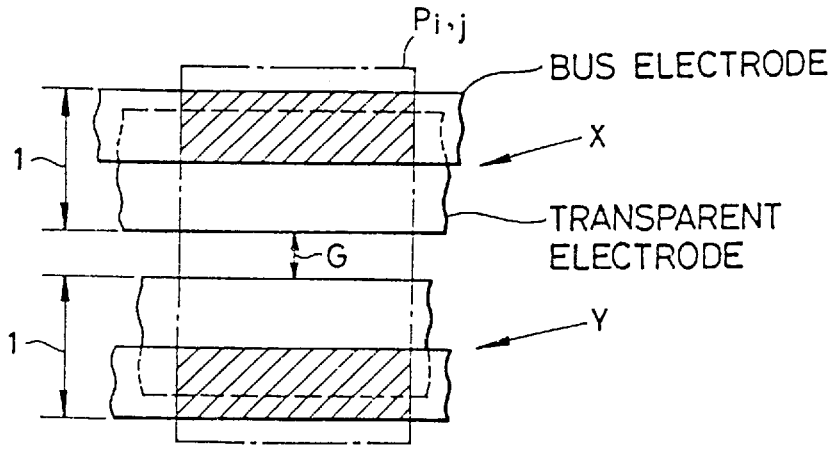
FIGS. 6A to 6C are partially enlarged plan views each showing a partial electrode pair corresponding to a pixel in a preferred embodiment according to the present invention.
Figure 6B:
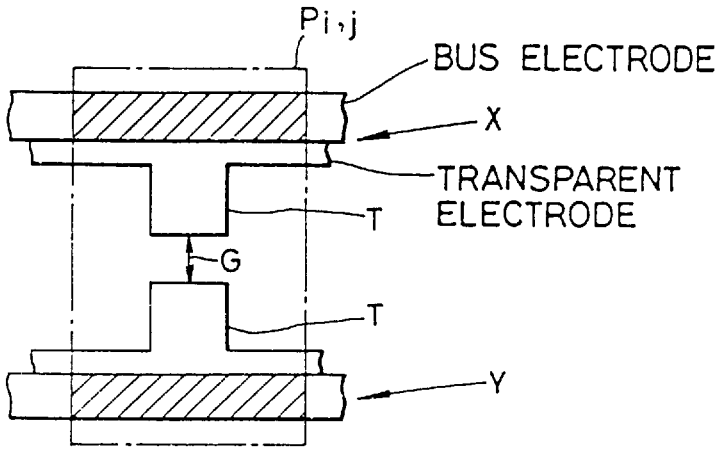
Figure 6C:
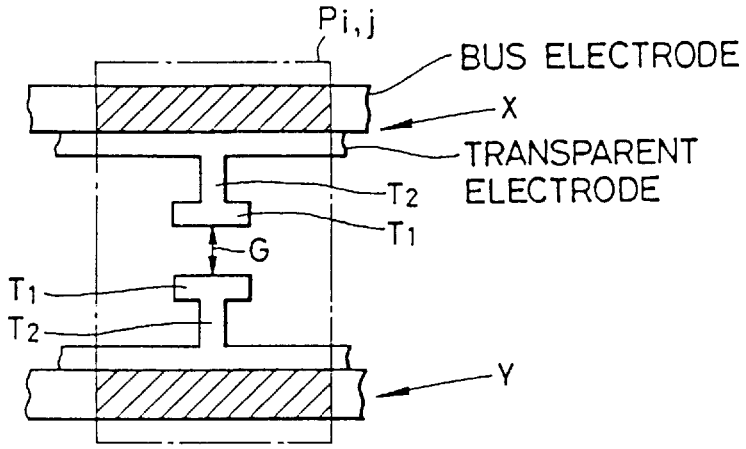

Furthermore, there is some possible decrease of contrast in the display surface due to the discharge emission caused by the second resetting pulses RPx2 applied to the electrodes. However, such a decrease of contrast may be avoided by selecting the width "l" of each row electrodes Xi, Yi to 300 micrometers or more as shown in FIG. 6A, because the expansion of effective area of the electrodes enhances the sustained discharge emission to improve relatively the contrast. Moreover, the pair of row electrodes may have projecting portions "T" from their bodies respectively opposite to each other through a discharge gap "G" in every pixel cell, as shown in FIG. 6B. Alternatively, each of the projecting portion comprises a wider portion "T1" positioned near the discharge gap "G" and a narrower portion "T2" bridging from the wider portion to the body, as shown in FIG. 6C. These projecting portions can localize the reset discharge caused by the first resetting pulses RPx1, RPy1 adjacent to the discharge gap "G" so as to reduce the reset discharge emission for improving relatively the contrast.

According to the method for driving a matrix type of plasma display panel of the present invention, the reduction of the differences of the wall charges in the pixel cell achieves a stable display operation in error-discharge free without any decrease of contrast caused by the application of the second resetting pulses following the first resetting pulses each having a long time constant.

What is claimed is:

1. A method for driving a matrix type of plasma display panel displaying an image, said plasma display panel including a plurality of row electrodes extending parallel to each other, two adjacent ones of said row electrodes being paired, and a plurality of column electrodes extending perpendicularly to the row electrodes at a given intervals wherein a region in which, one pair of row electrodes and one column electrode are crossed and spaced with a distance to each other at an intersection corresponding to one pixel, said method comprising the steps of:

applying first resetting pulses each having leading edge rising or falling gradually to all of the row electrodes simultaneously to cause discharges between all of the pairs of row electrodes to generate wall-charges within all pixel cells at once, each first resetting pulse having a pulse rise or fall time longer than each duration of the sustain pulse for sustaining a discharge emission as a simultaneous resetting step;

applying a second resetting pulse to one of the pair of row electrodes to cause discharge therebetween immediately after applying the first resetting pulse to the one of the pair of row electrodes, so as to eliminate influences to the pixel cells caused by the difference of wall charges in the pixel cells generated by the first resetting pulses each having leading edge rising gradually;

applying a scan pulse to every pair of row electrodes and simultaneously applying a pixel data pulse to every column electrodes to write pixel data to the associated pixels in accordance with pixel data pulses applied as a pixel data selecting or addressing step; and applying a series of sustain pulses alternately to one of the row electrode pair and the other thereof to maintain sustain-discharge between the pair of row electrodes.

2. A method according to claim 1, wherein the first resetting pulse comprises one resetting pulse having a predetermined polarity applied to the one of the row electrodes and an other resetting pulse having an inverse polarity to said predetermined polarity simultaneously applied to the other row electrode, and in that the second resetting pulse has an inverse polarity to said predetermined polarity.

3. A method according to claim 1 further comprising a step of applying a priming pulse to every pair of the row electrodes immediately before the scan pulse is applied thereto in the addressing step in such a manner that the paired priming pulse and scan pulse are applied every pair of the row electrodes one after another while equating the interval between the priming pulse and the scan pulse every electrode.

4. A method according to claim 1, wherein the wall charge in the pixel cell which has been produced by the first and second resetting pulses is selected in accordance with contents of the pixel data pulse to be lost in said pixel data selecting or addressing step.

5. A method for driving a matrix type of plasma display panel displaying an image, said plasma display panel including a plurality of row electrodes extending parallel to each other, two adjacent ones of said row electrodes being paired, and a plurality of column electrodes extending perpendicularly to the row electrodes at a given intervals wherein a region in which, one pair of row electrodes and one column electrode are crossed and spaced with a distance to each other at an intersection corresponding to one pixel in which each of said row electrodes has a width of 300 micrometers or more, said method comprising the steps of:

applying first resetting pulses each having leading edge rising or falling gradually to all of the row electrodes simultaneously to cause discharges between all of the pairs of row electrodes to generate wall-charges within all pixel cells at once, each first resetting pulse having a pulse rise or pulse fall time longer than each duration of the sustain pulse for sustaining a discharge emission as a simultaneous resetting step;

applying a second resetting pulse to one of the pair of row electrodes to cause discharge therebetween immediately after applying the first resetting pulse to the one of the pair of row electrodes, so as to eliminate influences to the pixel cells caused by the difference of wall charges in the pixel cells generated by the first resetting pulses each having leading edge rising gradually;

applying a scan pulse to every pair of row electrodes and simultaneously applying a pixel data pulse to every column electrodes to write pixel data to the associated pixels in accordance with pixel data pulses applied; and applying a series of sustain pulses alternately to one of the row electrode pair and the other thereof to maintain sustain-discharge between the pair of row electrodes.

6. A method for driving a matrix type of plasma display panel displaying an image, said plasma display panel including a plurality of row electrodes extending parallel to each other, two adjacent ones of said row electrodes being paired, and a plurality of column electrodes extending perpendicularly to the row electrodes at a given intervals wherein a region in which, one pair of row electrodes and one column electrode are crossed and spaced with a distance to each other at an intersection corresponding to one pixel in which the paired row electrodes have projecting portions respectively opposite to each other through a discharge gap, said method comprising the steps of:

applying first resetting pulses each having leading edge rising or falling gradually to all of the row electrodes simultaneously to cause discharges between all of the pairs of row electrodes to generate wall-charges within all pixel cells at once, each first resetting pulse having a pulse rise or pulse fall time longer than each duration of the sustain pulse for sustaining a discharge emission as a simultaneous resetting step;

applying a second resetting pulse to one of the pair of row electrodes to cause discharge therebetween immediately after applying the first resetting pulse to the one of the pair of row electrodes, so as to eliminate influences to the pixel cells caused by the difference of wall charges in the pixel cells generated by the first resetting pulses each having leading edge rising gradually:

applying a scan pulse to every pair of row electrodes and simultaneously applying a pixel data pulse to every column electrodes to write pixel data to the associated pixels in accordance with pixel data pulses applied; and applying a series of sustain pulses alternately to one of the row electrode pair and the other thereof to maintain sustain-discharge between the pair of row electrodes.

7. A method for driving a matrix type of plasma display panel displaying an image, said plasma display panel including a plurality of row electrodes extending parallel to each other, two adjacent ones of said row electrodes being paired, and a plurality of column electrodes extending perpendicularly to the row electrodes at a given intervals wherein a region in which, one pair of row electrodes and one column electrode are crossed and spaced with a distance to each other at an intersection corresponding to one pixel in which the paired row electrodes have projecting portions respectively opposite to each other through a discharge gap, each of said projecting portion having a wider portion positioned near the discharge gap and a narrower portion extending from the wider portion, said method comprising the steps of:

applying first resetting pulses each having leading edge rising or falling gradually to all of the row electrodes simultaneously to cause discharges between all of the pairs of row electrodes to generate wall-charges within all pixel cells at once, each first resetting pulse having a pulse rise or pulse fall time longer than each duration of the sustain pulse for sustaining a discharge emission as a simultaneous resetting step;

applying a second resetting pulse to one of the pair of row electrodes to cause discharge therebetween immediately after applying the first resetting pulse to the one of the pair of row electrodes, so as to eliminate influences to the pixel cells caused by the difference of wall charges in the pixel cells generated by the first resetting pulses each having leading edge rising gradually;

applying a scan pulse to every pair of row electrodes and simultaneously applying a pixel data pulse to every column electrodes to write pixel data to the associated pixels in accordance with pixel data pulses applied; and applying a series of sustain pulses alternately to one of the row electrode pair and the other thereof to maintain sustain-discharge between the pair of row electrodes.

* * * * *